US006161235A

United States Patent [19]

Smith et al.

[11] Patent Number: 6,161,235

[45] Date of Patent: Dec. 19, 2000

[54] BED SHEET SECURING DEVICE

[76] Inventors: Lenore Smith; Linda Thompson, both of 6970 Factory Shoals Rd., Austell, Ga. 30168

[21] Appl. No.: 09/243,406

[22] Filed: Feb. 1, 1999

[51] Int. Cl.[7] ..... A47C 21/02

[52] U.S. Cl. ..... 5/504.1; 5/496; 5/498

[58] Field of Search ..... 5/504.1, 922, 923, 5/498, 496, 499, 482

[56] References Cited

U.S. PATENT DOCUMENTS

| | | | |
|---|---|---|---|
| 3,092,848 | 6/1963 | Gronvold | 5/320 |
| 4,662,016 | 5/1987 | Seeman | 5/508 |
| 4,807,316 | 2/1989 | Whipple | 5/493 |
| 4,891,856 | 1/1990 | Thornhill | 5/496 |
| 4,937,904 | 7/1990 | Ross | 5/497 |
| 5,005,239 | 4/1991 | Clark | 5/451 |
| 5,072,470 | 12/1991 | Lysiak | 5/496 |
| 5,179,743 | 1/1993 | Lanman | 5/498 |
| 5,263,212 | 11/1993 | Garcia | 5/496 |
| 5,325,554 | 7/1994 | Lewis | 5/498 |

*Primary Examiner*—Lynne H. Browne
*Assistant Examiner*—James M Hewitt
*Attorney, Agent, or Firm*—Joseph N. Breaux

[57] ABSTRACT

A bed sheet securing device that includes a number of fasteners in connection with a harness for holding the corners of a bed sheet in place over a mattress. A number of additional fasteners are provided that are securable to the bottom edge of a flat cover sheet to prevent the bottom edge of the cover sheet from slipping out from under the mattress.

1 Claim, 3 Drawing Sheets

BED SHEET SECURING DEVICE

BACKGROUND OF THE INVENTION

1. Field of the Invention

The present invention relates to bed clothing and more particularly to a bed sheet securing device that includes a center X-shaped harness assembly having four harness ends each having a two sided hook and pile fastener section terminating in a V-shaped fastener structure having two two-posted fastener members; a rearwardly directed harness section extending from a center intersection of the X-shaped harness assembly having a two sided hook and pile fastener section terminating in a fastener structure having a two-posted fastener member; six Y-shaped detachable fastener assemblies each including a hook and pile fastener section companionate with any of the two sided hook and pile fastener sections and two securing rings each sized and shaped to engage and hold one of the resilient, curve sided fastener posts of any of the two-posted fastener members; and two elongated detachable fastener assemblies each including a hook and pile fastener section companionate with any of the two sided hook and pile fastener sections and having a securing ring sized and shaped to engage and hold one of the resilient, curve sided fastening posts of any of the two-posted fastener members; each of the resilient, curve sided fastener posts are oriented oppositely from each other.

2. Background Art

It can be bothersome when bed sheets become loose and slip off the mattresses. It would be a benefit, therefore, to have a bed sheet securing device that included a number of fasteners in connection with a harness that would be securable to the corners of the bed sheet to maintain the bed sheet over the mattress.

BRIEF SUMMARY OF THE INVENTION

It is thus an object of the invention to provide a bed sheet securing device that includes a number of fasteners in connection with a harness for holding the corners of a bed sheet over a mattress.

BRIEF DESCRIPTION OF THE SEVERAL VIEWS OF THE DRAWINGS

For a further understanding of the nature and objects of the present invention, reference should be made to the following detailed description, taken in conjunction with the accompanying drawings, in which like elements are given the same or analogous reference numbers and wherein.

DETAILED DESCRIPTION OF THE INVENTION

Figure 1:
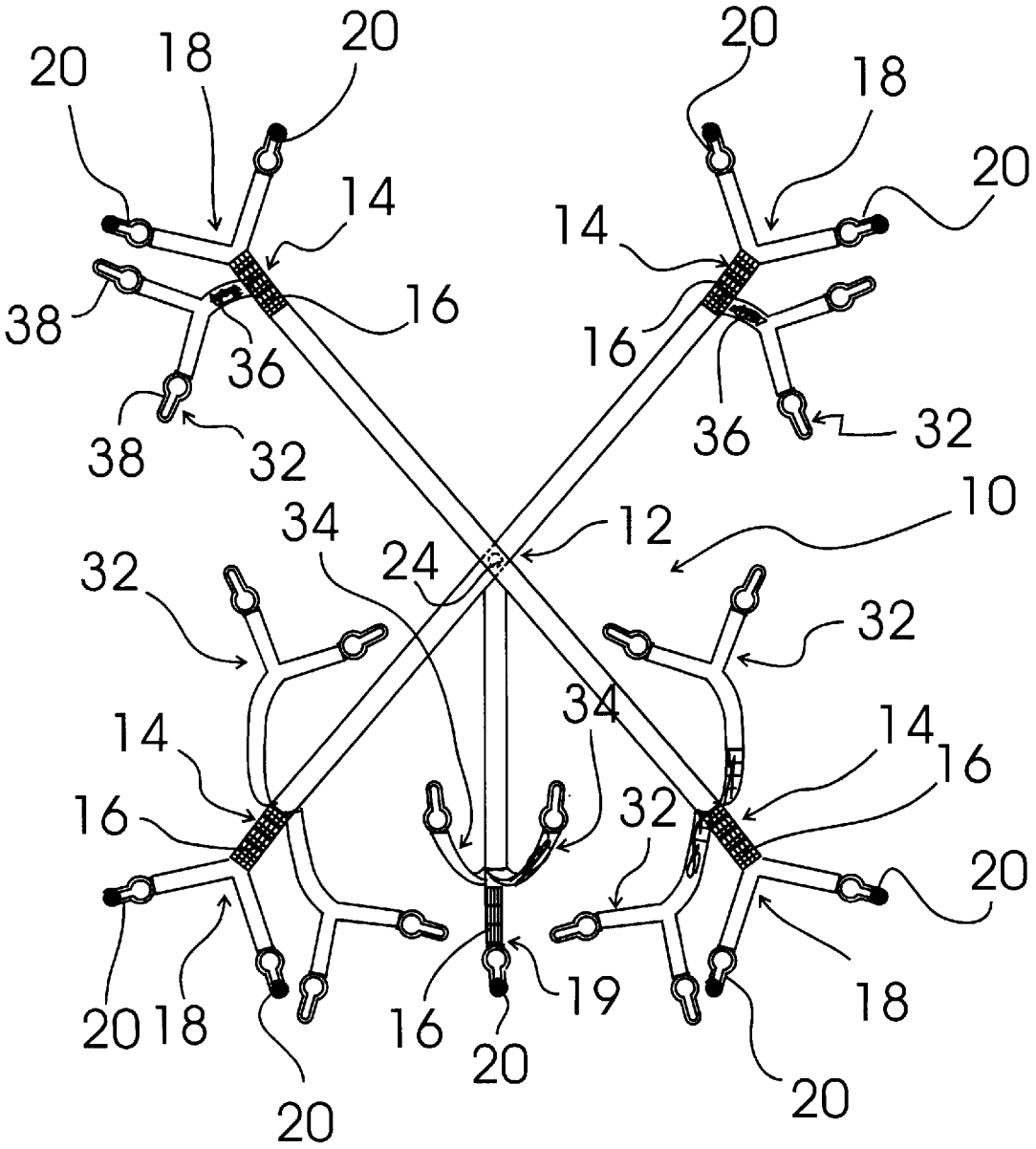
FIG. 1 is a plan view showing an exemplary embodiment of the bed sheet securing device of the present invention.

FIG. 1 shows an exemplary embodiment of the bed sheet securing device of the present invention generally designated 10. Bed sheet securing device 10 includes a center X-shaped nylon strapping harness assembly, generally designated 12; a rearwardly directed harness section 22; six Y-shaped detachable fastener assemblies, generally designated 32; and two elongated detachable fastener assemblies 34.

Center X-shaped harness assembly 12 has four harness ends 14 each having a two sided hook and pile fastener section 16 that terminates in a V-shaped fastener structure, generally designated 18. Each V-shaped fastener strcuture 18 has a two-posted fastener member 20 at the end of each branch.

Figure 2:
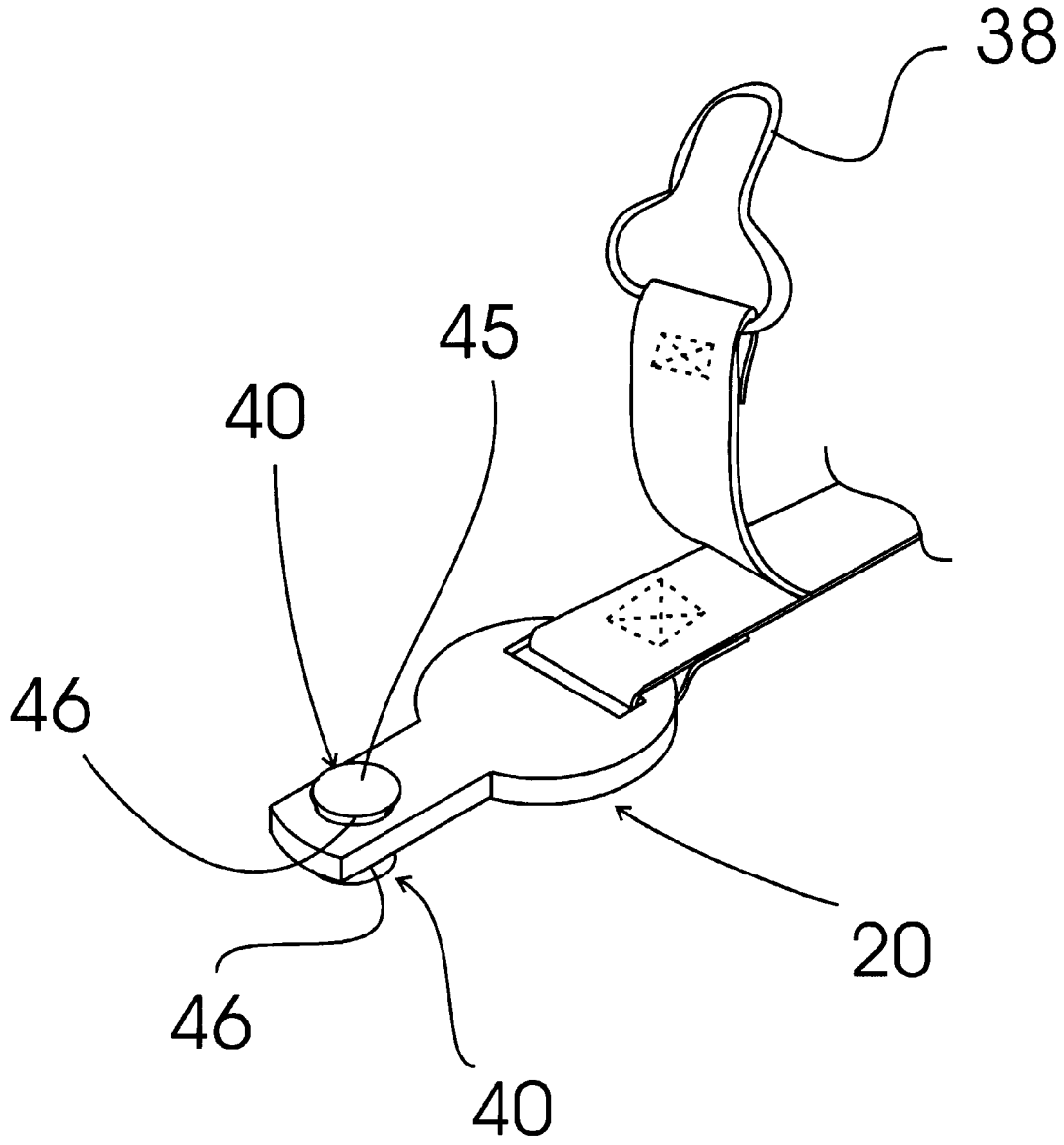
FIG. 2 is a detail perspective view showing one of the two-posted fastener members including the harness attachment opening and the two oppositely oriented resilient, curve sided fastener posts; and one of the securing rings sized and shaped to engage and hold one of the resilient, curve sided fastener posts.

Rearwardly directed harness section 22 extends from a center intersection 24 of X-shaped harness assembly 12 and includes a two sided hook and pile fastener section 16 that terminates in a single fastener structure 19 having a two-posted fastener member 20. Each of the six identical Y-shaped detachable fastener assemblies 32 includes a hook and pile fastener section 36 companionate with any of the two sided hook and pile fastener sections 16 and two securing rings 38, referring now to FIG. 2, each sized and shaped to engage and hold one of the resilient, curve sided fastener posts 40 of any of the two-posted fastener members 20. In use, the sheet is placed over a resilient, curve sided fastener post 40 and securing ring 38 is snap fit over the sheet section and the top 44 of fastener post 40 and into a circumferential, inwardly curved ring retaining channel 46. The two identical elongated detachable fastener assemblies 34 each include a hook and pile fastener section 36 that is companionate with any of the two sided hook and pile fastener sections 16 and has a securing ring 38 as previously described.

Figure 3:
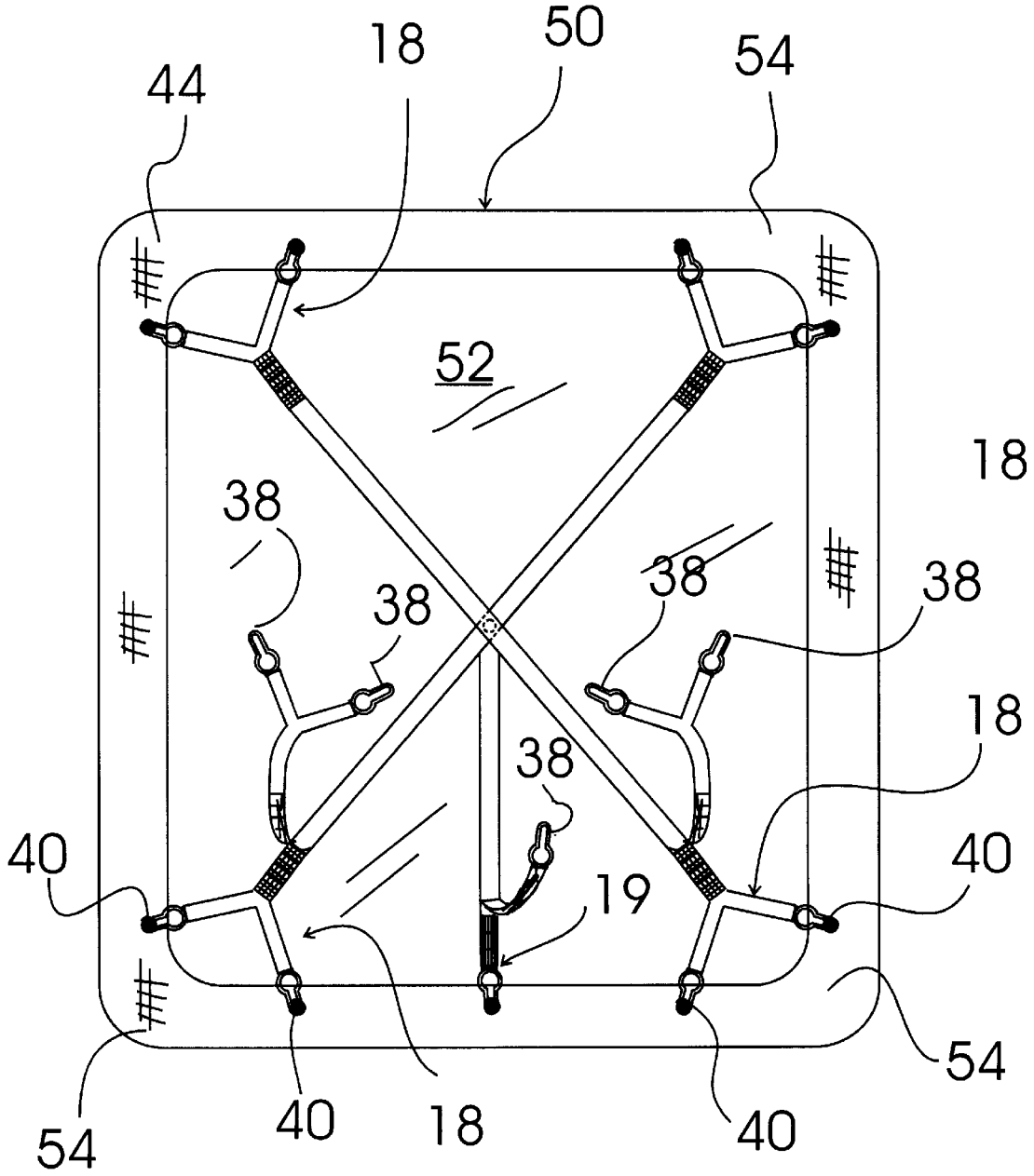
FIG. 3 is a plan view of the underside of a representative mattress with a fitted sheet installed and held in place with the exemplary bed sheet securing device of the present invention and showing five unused resilient, curve sided fastener posts and respective securing rings available to secure the bottom edge of a flat covering sheet if desired.

Referring now to FIG. 3, in use a fitted bed sheet, generally designated 50 is placed over a mattress 52 and each of the four corners 54 secured to a V-shaped fastener and the bottom center 56 secured to single fastening structure 19 as previously described. In this embodiment, five unused resilient, curve sided fastener posts 40 and five respective securing rings 38 are available to secure the bottom edge of a flat covering sheet if desired.

It can be seen from the preceding description that a bed sheet securing device has been provided that includes a number of fasteners in connection with a harness for holding the corners of a bed sheet over a mattress; and that includes a center X-shaped harness assembly having four harness ends each having a two sided hook and pile fastener section terminating in a V-shaped fastener structure having two two-posted fastener members; a rearwardly directed harness section extending from a center intersection of the X-shaped harness assembly having a two sided hook and pile fastener section terminating in a fastener structure having a two-posted fastener member; six Y-shaped detachable fastener assemblies each including a hook and pile fastener section companionate with any of the two sided hook and pile fastener sections and two securing rings each sized and shaped to engage and hold one of the resilient, curve sided fastener posts of any of the two-posted fastener members; and two elongated detachable fastener assemblies each including a hook and pile fastener section companionate with any of the two sided hook and pile fastener sections and having a securing ring sized and shaped to engage and hold one of the resilient, curve sided fastening posts of any of the two-posted fastener members; each of the resilient, curve sided fastener posts are oriented oppositely from each other.

It is noted that the embodiment of the bed sheet securing device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A bed sheet securing device comprising:

a center X-shaped harness assembly having four harness ends, each harness end having a hook and pile fastener section having hook and pile material provided on each side thereof, each hook and pile fastener section terminating in a V-shaped fastener structure having two members each having a resilient, curve sided fastener post on each side of each member;

a harness section extending from a center intersection of said X-shaped harness assembly having a hook and pile fastener section having hook and pile material provided on each side thereof, each hook and pile fastener section terminating in a fastener structure having a fastener member having a resilient, curve sided fastener post on each side thereof;

six Y-shaped detachable fastener assemblies each including a hook and pile fastener section companionate with any of said hook and pile fastener sections and two securing rings each sized and shaped to engage and hold one of said resilient, curve sided fastener posts of any of said members; and two elongated detachable fastener assemblies Each including a hook and pile fastener section companionate with any of said hook and pile fastener sections and having a securing ring sized and shaped to engage and hold one of said resilient, curve sided fastening posts of any of said members.

* * * * *